US007835656B2

(12) United States Patent
Iwata et al.

(10) Patent No.: US 7,835,656 B2
(45) Date of Patent: Nov. 16, 2010

(54) DEVELOPING DEVICE AND IMAGE FORMING APPARATUS WHICH CAN DETECT A CONCENTRATION OF A DEVELOPER

(75) Inventors: Naoya Iwata, Hadano (JP); Takashi Sakamoto, Ebina (JP); Akihide Kawamura, Ebina (JP); Kei Hirata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 290 days.

(21) Appl. No.: 12/058,880

(22) Filed: Mar. 31, 2008

(65) Prior Publication Data

US 2009/0074468 A1 Mar. 19, 2009

(30) Foreign Application Priority Data

Sep. 19, 2007 (JP) ..... 2007-241671

(51) Int. Cl.
*G03G 15/08* (2006.01)

(52) U.S. Cl. ..... 399/62; 399/254; 399/256

(58) Field of Classification Search ..... 399/30, 399/62, 63, 254, 255, 256, 272, 281
See application file for complete search history.

(56) References Cited

U.S. PATENT DOCUMENTS

| | | | | |
|---|---|---|---|---|
| 5,122,834 | A * | 6/1992 | Okamoto et al. | 399/63 |
| 5,722,002 | A * | 2/1998 | Kikuta et al. | 399/30 |
| 6,104,892 | A * | 8/2000 | Kobayashi et al. | 399/63 |
| 6,768,881 | B2 * | 7/2004 | Hatori | 399/63 |
| 7,346,286 | B2 * | 3/2008 | Matsumoto et al. | 399/29 |
| 7,409,170 | B2 * | 8/2008 | Mizuta | 399/27 |
| 2007/0081832 | A1 * | 4/2007 | Yoshida et al. | 399/254 |

FOREIGN PATENT DOCUMENTS

| | | | |
|---|---|---|---|
| JP | 63-150962 | U | 10/1988 |
| JP | 8-36297 | A | 2/1996 |

* cited by examiner

*Primary Examiner*—Robert Beatty
(74) *Attorney, Agent, or Firm*—Sughrue Mion, PLLC

(57) ABSTRACT

A developing device includes: a developer carrier; a first housing chamber; a second housing chamber; a first inflow portion; a first conveying member; a second conveying member; and a concentration detecting member.

14 Claims, 10 Drawing Sheets

DEVELOPING DEVICE AND IMAGE FORMING APPARATUS WHICH CAN DETECT A CONCENTRATION OF A DEVELOPER

CROSS-REFERENCE TO RELATED APPLICATIONS

This application is based on and claims priority under 35 U.S.C. 119 from Japanese Patent Application No. 2007-241671 filed Sep. 19, 2007.

BACKGROUND

Technical Field

The present invention relates to a developing device and an image forming apparatus.

SUMMARY

A technical problem to be solved by the invention is to maintain the inflow amount in a first inflow portion which allows a developer to flow upward in the gravitational direction, and the accuracy of detection of the concentration of the developer in a concentration detecting portion in which the developer is stirred in a circumferential direction, and stagnation of the developer easily occurs, in the case where the developer stagnates.

According to an aspect of the present invention, a developing device including: a developer carrier that is rotated while holding a developer on a surface; a first housing chamber that houses the developer to be supplied to the developer carrier; a second housing chamber that has a bottom face that is provided beneath a bottom face of the first housing chamber in a gravitational direction; a first inflow portion that allows the developer to flow from the second housing chamber into the first housing chamber; a first conveying member that is provided in the first housing chamber, and that conveys the developer in the first housing chamber; a second conveying member that is provided in the second housing chamber, and that conveys the developer in the second housing chamber in a second conveying direction directed toward the developer housing chamber; and a concentration detecting member that is provided in the bottom face of the second housing chamber on an upstream side of the first inflow portion in the second conveying direction, and that detects a concentration of the developer housed in the second housing chamber, wherein the second conveying member includes: a stirring member that is provided at a region opposed to the concentration detecting member, and that stirs the developer in a circumferential direction of the stirring member by making a first conveying force in the circumferential direction greater than a second conveying force in an axial direction of the stirring member, the second housing chamber includes: an inner wall face that is positioned in a region opposed to the first inflow portion, and that is formed into a shape extending along an outer shape of the second conveying member; and a recess that is provided in an inner wall face of a region opposed to the concentration detecting member, and in which a sectional area of the region opposed to the concentration detecting member and perpendicular to the second conveying direction is larger than a sectional area of the region opposed to the first inflow portion and perpendicular to the second conveying direction.

BRIEF DESCRIPTION OF THE DRAWINGS

Exemplary embodiment of the present invention will be described in detail based on the following figures, wherein:

FIG. 3A is a partial section perspective view showing main portions in a state where a developing container cover is removed away, FIG. 3B is a view illustrating a first conveying member, and FIG. 3C is a view illustrating a second conveying member;

FIG. 6A is a view showing a state where the developing container cover is opened, and FIG. 6B is a section view taken along the line VIB-VIB in FIG. 5;

FIG. 10A is a view showing a state where the developing container cover is opened, and FIG. 10B is a section view of main portions.

DETAILED DESCRIPTION

Figure 1:
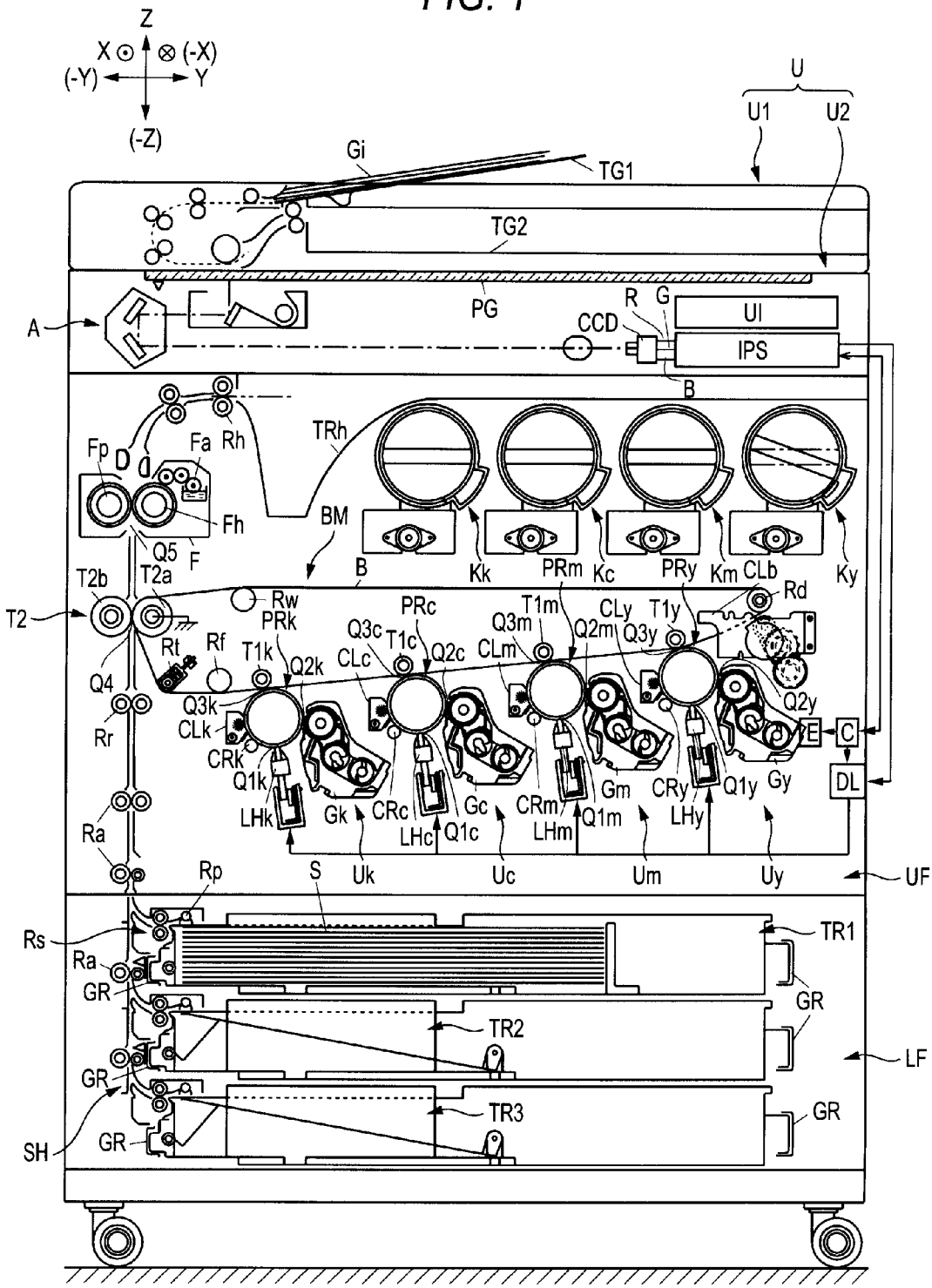
FIG. 1 is a diagram illustrating the whole of an image forming apparatus of Example 1 of the invention.

Next, examples which are exemplary embodiments of the invention will be described with reference to the accompanying drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "603" indicates the arrow which is directed from the rear of the sheet to the front, and that in which "×" is written in "○" indicates the arrow which is directed from the front of the sheet to the rear.

In the following description with reference to the drawings, illustrations of members other than those which are necessary in description are suitably omitted for the sake of easy understanding.

Example 1

FIG. 1 is a diagram illustrating the whole of an image forming apparatus of Example 1 of the invention.

Referring to FIG. 1, the image forming apparatus U comprises an automatic document conveying device U1, and an image forming apparatus body U2 which supports the device, and which has a transparent document reading face PG in the upper end.

The automatic document conveying device U1 has: a document feeding portion TG1 in which plural documents Gi to be copied are housed in a stacked manner; and a document discharging portion TG2 to which the documents Gi fed from the document feeding portion TG1 and passed through a document reading position on the document reading face PG are discharged.

The image forming apparatus body U2 has an operation portion U1 through which the user inputs an operation command signal such as the start of an image forming operation, an exposing optical system A, etc.

Reflected light from a document which is conveyed on the document reading face PG by the automatic document conveying device U1, or that which is manually placed on the document reading face PG is passed through the exposing optical system A and converted by a solid-state imaging element CCD to electric signals of red R, green G, and blue B.

An image information converting portion IPS converts the electric signals of RGB to image information of black K, yellow Y, magenta M, and cyan C supplied from the solid-state imaging element CCD, temporarily stores the image information, and supplies the image information at a predetermined timing as image information for forming latent images, to a latent-image forming device driving circuit DL.

In the case where the document image is a single-color image or a so-called monochromatic image, only image information of black K is supplied to the latent-image forming device driving circuit DL.

The latent-image forming device driving circuit DL has driving circuits (not shown) for the respective colors Y, M, C, and K, and supplies signals corresponding to the input image information at predetermined timings, to latent-image forming devices LHy, LHm, LHc, LHk which are disposed for the respective colors.

Figure 2:
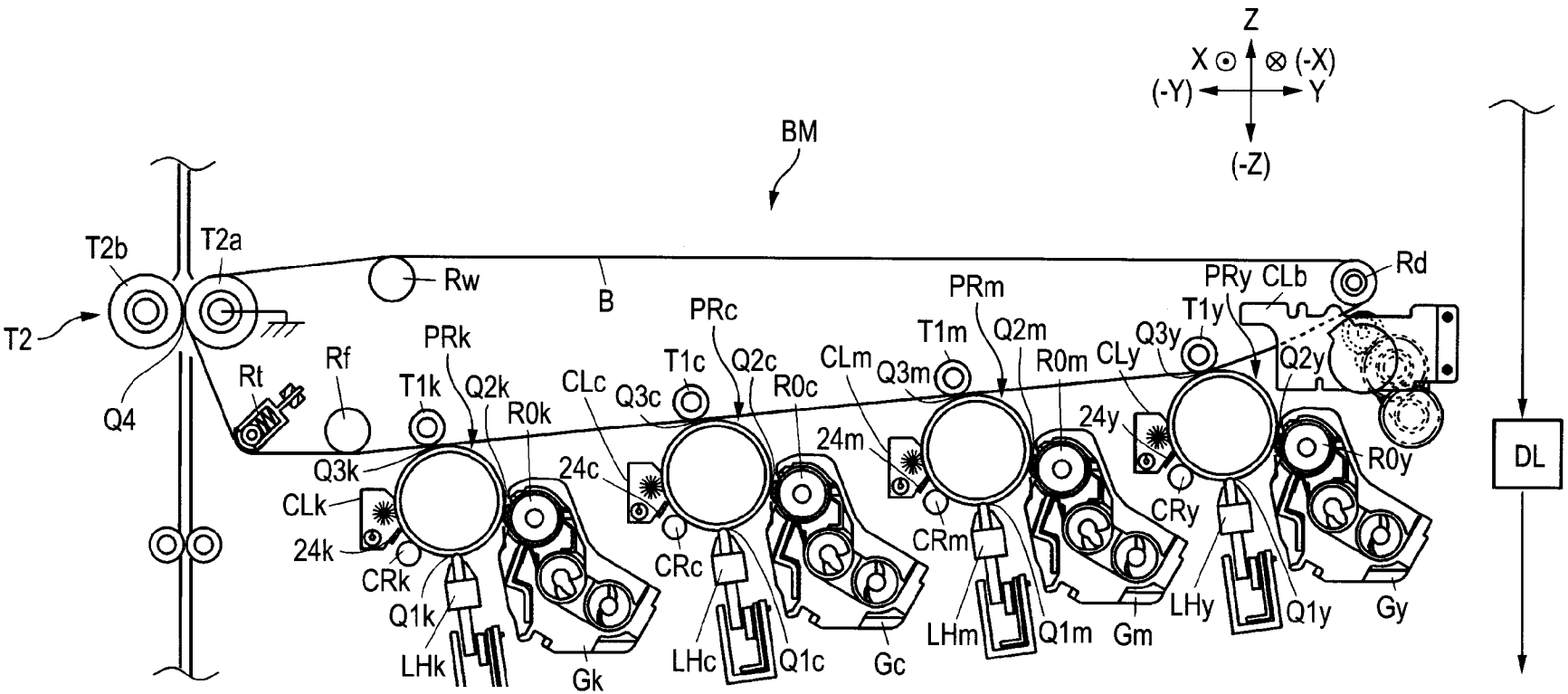
FIG. 2 is an enlarged view illustrating main portions of the image forming apparatus of Example 1.

FIG. 2 is an enlarged view illustrating main portions of the image forming apparatus of Example 1.

Visible-image forming devices Uy, Um, Uc, Uk which are placed in a middle portion in the gravitational direction of the image forming apparatus U form visible images of the colors Y, M, C, and K, respectively.

Latent-image writing beams Ly, Lm, Lc, and Lk of Y, M, C, and K emitted from latent-image writing light sources of the latent-image forming devices LHy to LHk impinge on rotary image carriers PRy, PRm, PRc, PRk, respectively. In Example 1, the latent-image forming devices LHy to LHk are configured by so-called LED arrays, respectively.

The image forming apparatus Uy for Y has the rotary image carrier PRy, a charging device CRy, the latent-image forming device LHy, a developing device Gy, a transferring device T1*y*, and an image-carrier cleaner CLy. In Example 1, the image carrier PRy, the charging device CRy, and the image-carrier cleaner CLy are configured by an image carrier unit which is integrally attachable to and detachable from the image forming apparatus body U2.

The visible-image forming devices Um, Uc, Uk are configured in a similar manner as the visible-image forming device Uy for Y.

Referring to FIGS. 1 and 2, the image carriers PRy, PRm, PRc, PRk are charged by the respective charger devices CRy, CRm, CRc, CRk, and, at image writing stations Q1*y*, Q1*m*, Q1*c*, Q1*k*, electrostatic latent images are formed in their surfaces by the latent-image writing beams Ly, Lm, Lc, Lk. In developing regions Q2*y*, Q2*m*, Q2*c*, Q2*k*, the electrostatic latent images in the surfaces of the image carriers PRy, PRm, PRc, PRk are developed into toner images which are examples of visible images by developers held by developing rolls R0*y*, R0*m*, R0*c*, R0*k* which are examples of developer carriers of the developing devices Gy, Gm, Gc, Gk.

The developed toner images are conveyed to primary transferring regions Q3*y*, Q3*m*, Q3*c*, Q3*k* which are contacted with an intermediate transfer belt B that is an example of an intermediate transferring member. At a predetermined timing, a power source circuit E which is controlled by a controller C applies a primary transfer voltage in which the polarity is opposite to the charging polarity of the toner, to primary transferring devices T1*y*, T1*m*, T1*c*, T1*k* placed on the rear face side of the intermediate transfer belt B in the primary transferring regions Q3*y*, Q3*m*, Q3*c*, Q3*k*.

The toner images on the image carriers PRy to PRk are primarily transferred to the intermediate transfer belt B by the primary transferring devices T1*y*, T1*m*, T1*c*, T1*k*. Residuals and adhesions on the surfaces of the image carriers PRy, PRm, PRc, PRk after the primary transfer are cleaned by the image-carrier cleaners CLy, CLm, CLc, CLk. The surfaces of the image carriers PRy, PRm, PRc, PRk which have been cleaned are again charged by the charging devices CRy, CRm, CRc, CRk.

A belt module BM which is an example of an intermediate transferring device, and which is vertically movable and forward extractable is placed above the image carriers PRy to PRk. The belt module BM has: the intermediate transfer belt B; a belt driving roll Rd which is an example of an intermediate-transferring member driving member; a tension roll Rt which is an example of an intermediate-transferring member stretching member; a walking roll Rw which is an example of a meandering preventing member; an idler roll Rf which is an example of a driven member; a backup roll T2*a* which is an example of a secondary-transfer region opposing member; and the primary transferring devices T1*y*, T1*m*, T1*c*, T1*k*. The intermediate transfer belt B is supported in a rotary movable manner by the belt supporting rolls Rd, Rt, Rw, Rf, T2*a* which are examples of an intermediate-transferring member support member configured by the rolls Rd, Rt, Rw, Rf, T2*a*.

A secondary transfer roll T2*b* which is an example of a secondary transfer member is placed while opposing to the surface of the intermediate transfer belt B contacted with the backup roll T2*a*. A secondary transferring device T2 is configured by the rolls T2*a*, T2*b*. A secondary transferring region Q4 is formed in a region where the secondary transferring device T2*b* and the intermediate transfer belt B are opposed to each other.

The single- or multi-color toner images which are sequentially stackingly transferred onto the intermediate transfer belt B by the primary transferring devices T1*y*, T1*m*, T1*c*, T1*k* in the primary transferring regions Q3*y*, Q3*m*, Q3*c*, Q3*k* are conveyed to the secondary transferring region Q4.

Three pairs of right and left guide rails GR which are examples of a guiding member are disposed below the visible-image forming devices Uy to Uk. Sheet feeding trays TR1 to TR3 which are examples of a sheet feeding container are supported by the guide rails GR so as to be movable in the front and rear directions. Recording sheets S which are examples of media housed in the sheet feeding trays TR1 to TR3 are taken out by a pickup roll Rp which is an example of a medium taking out member, and separated one by one by a separating roll Rs which is an example a medium separating member. Then, the recording sheet is conveyed by plural conveying rolls Ra which are examples of a medium conveying member, along a sheet conveying path SH which is an example a medium conveying path, and sent to a registration roll Rr which is an example a transfer-region conveyance timing adjusting member, and which is disposed on the upstream side of the secondary transferring region Q4 in the sheet conveying direction. A sheet conveying device (SH+Ra+Rr) is configured by the sheet conveying path SH, the sheet conveying rolls Ra, the registration roll Rr, etc.

The registration roll Rr conveys the recording sheet S to the secondary transferring region Q4 in timing with the conveyance of the toner image formed on the intermediate transfer belt B to the secondary transferring region Q4. When the recording sheet S is passed through the secondary transferring region Q4, the backup roll T2*a* is grounded, and the power source circuit E which is controlled by the controller C applies a secondary transfer voltage which is opposite to the charging polarity of the toner, to the secondary transferring device T2*b*. At this time, the toner image on the intermediate transfer belt B is transferred to the recording sheet S by the secondary transferring device T2.

After the secondary transfer, the intermediate transfer belt B is cleaned by a belt cleaner CLb which is an example of an intermediate-transferring member cleaner.

The recording sheet S onto which the toner image has been secondarily transferred is conveyed to a fixing region Q5 which is a press contact region between a heating roll Fh that is an example of a heating fixing member of a fixing device F, and a pressuring roll Fp that is an example of a pressuring fixing member, and subjected to heating fixation when passed through the fixing region. The recording sheet S which has undergone heating fixation is discharged to a discharge tray TRh which is an example of a medium discharging portion, from a discharging roller Rh which is an example of a medium discharging member.

A release agent which improves the property of releasing of the recording sheet S from the heating roll is applied to the surface of the heating roll Fh by a release-agent applying device Fa.

Developer cartridges Ky, Km, Kc, Kk which are examples of developer replenishment containers respectively housing developers of yellow Y, magenta M, cyan C, and black K are arranged above the belt module BM. The developers housed in the developer cartridges Ky, Km, Kc, Kk are replenished to the developing devices Gy, Gm, Gc, Gk in accordance with consumptions of the developers of the developing devices Gy, Gm, Gc, Gk, through developer replenishment paths which will be described later. In Example 1, each developer is configured by a two-component developer containing a magnetic carrier, and a toner to which an external additive is added.

Referring to FIG. 1, the image forming apparatus U has an upper frame UF and a lower frame LF. The upper frame UF supports the visible-image forming devices Uy to Uk and the components which are placed above the visible-image forming devices Uy to Uk, i.e., the belt module BM, etc.

The lower frame LF supports the guide rails GR supporting the sheet feeding trays TR1 to TR3, the sheet feeding members which feed sheets from the trays TR1 to TR3, i.e., the pickup roll Rp, the separating roll Rs, the sheet conveying rolls Ra, etc.

(Description of Developing Device)

Figure 3A:
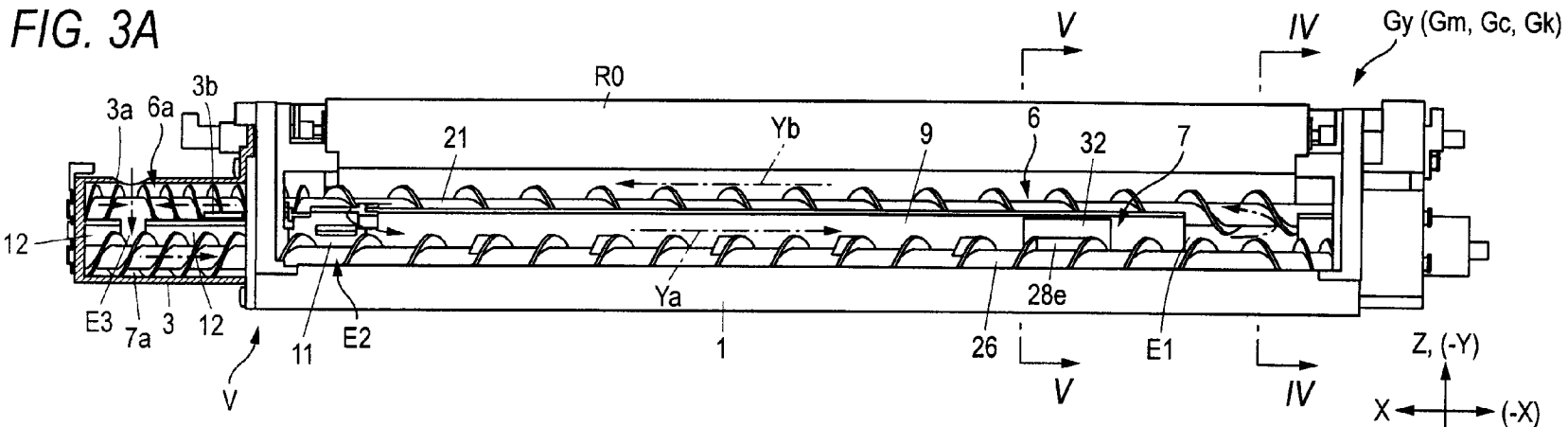
FIGS. 3A to 3C are views illustrating a developing device of Example 1 of the invention.
Figure 3B:
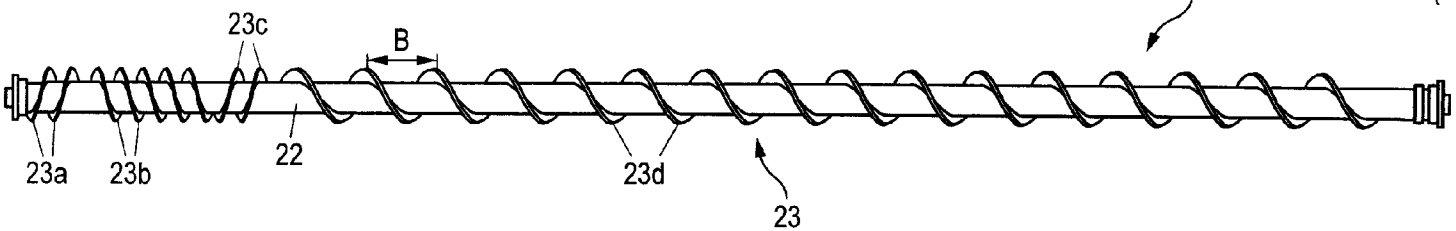
Figure 3C:
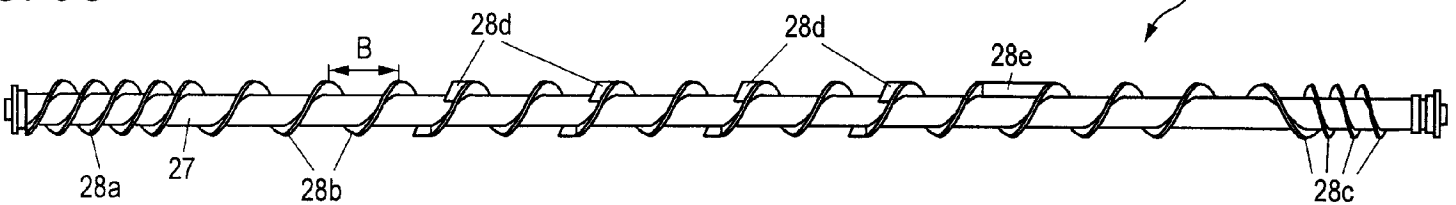

FIG. 3 is a view illustrating the developing device of Example 1 of the invention, FIG. 3A is a partial section perspective view showing main portions in a state where a developing container cover is removed away, FIG. 3B is a view illustrating a first conveying member, and FIG. 3C is a view illustrating a second conveying member.

Figure 4:
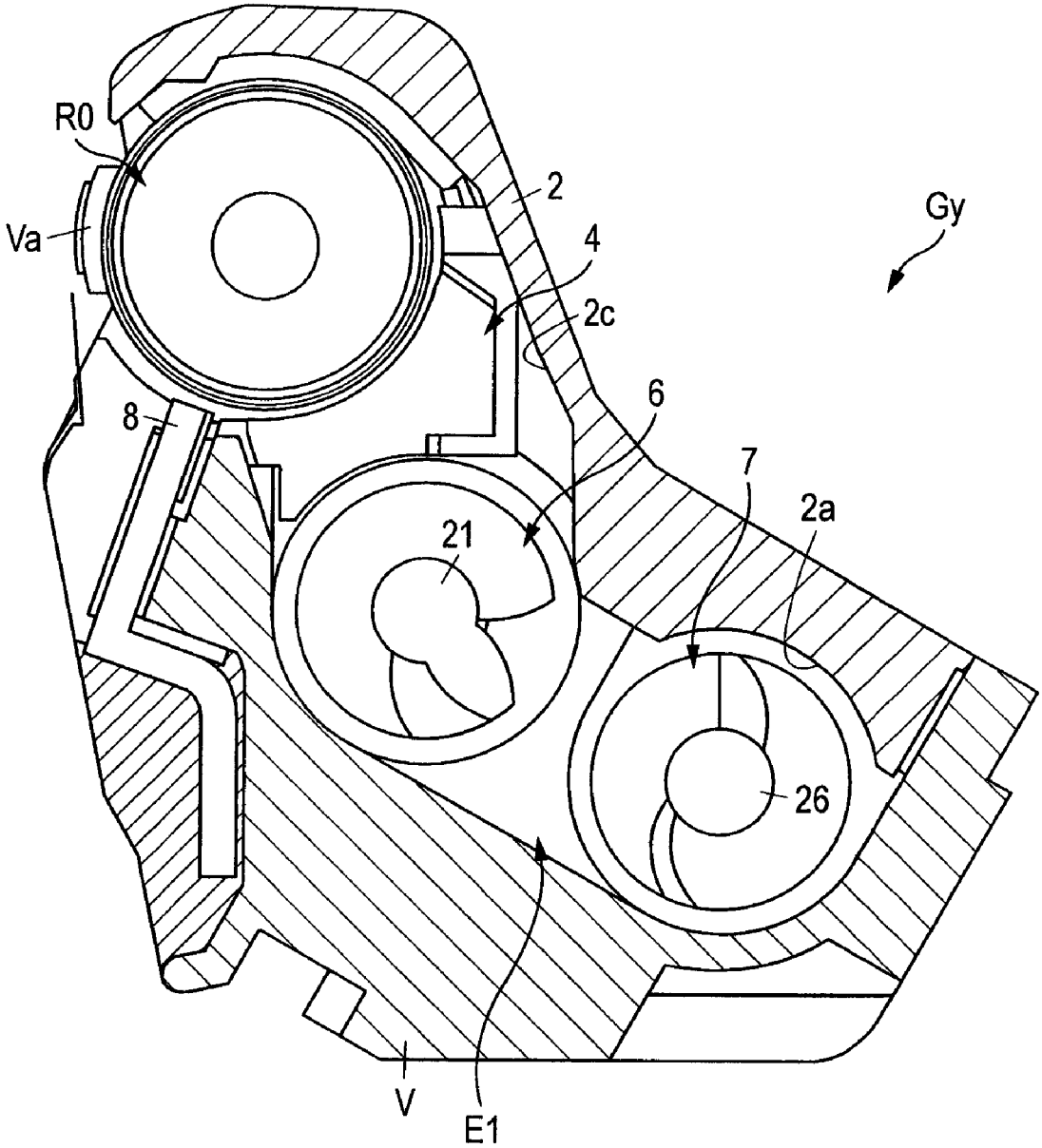
FIG. 4 is a section view taken along the line IV-IV in FIG. 3A.

FIG. 4 is a section view taken along the line IV-IV in FIG. 3A.

Figure 5:
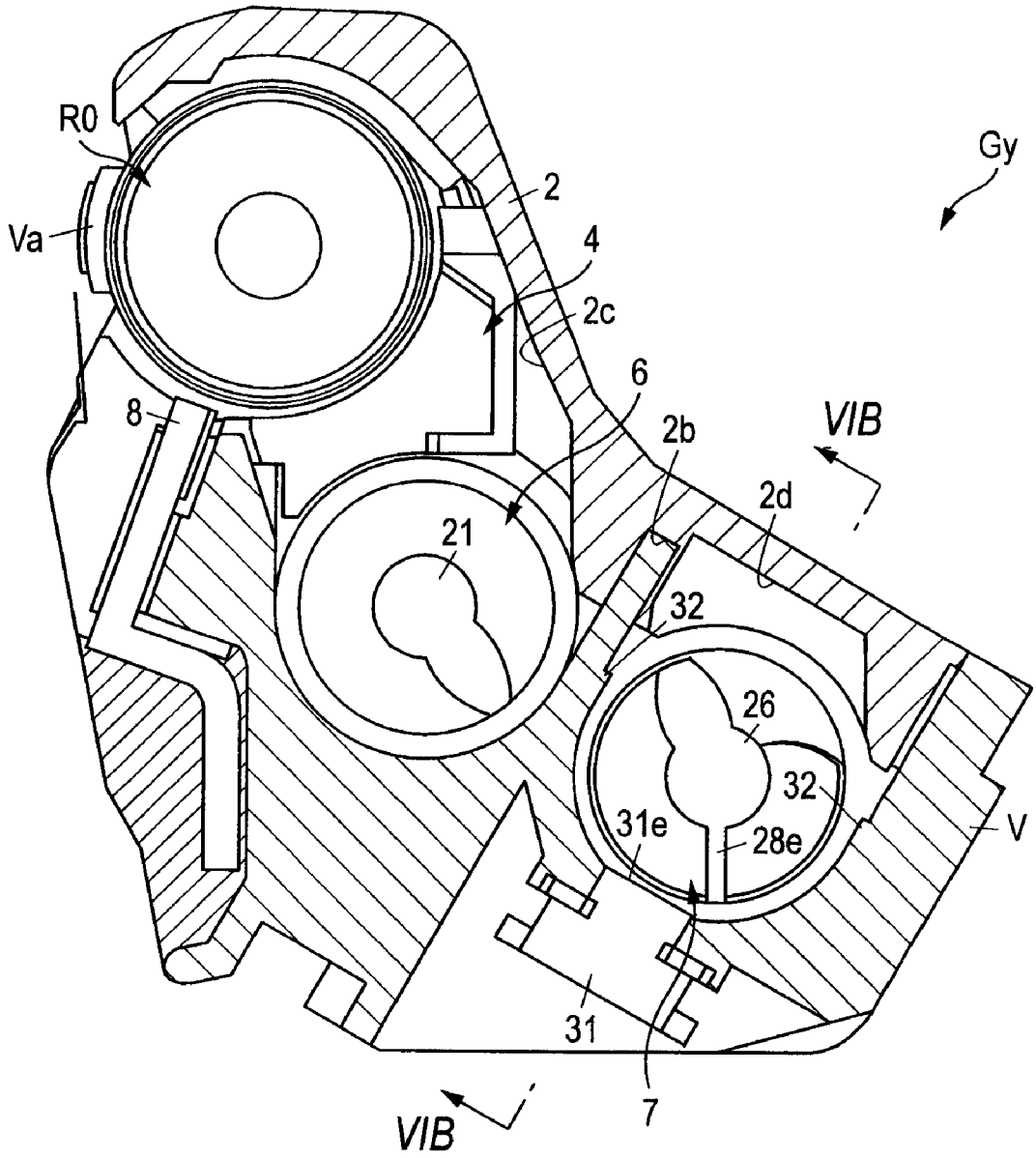
FIG. 5 is a section view taken along the line V-V in FIG. 3A.

FIG. 5 is a section view taken along the line V-V in FIG. 3A.

Next, the developing devices Gy, Gm, Gc, Gk of Example 1 of the invention will be described. Since the developing devices Gy, Gm, Gc, Gk for the respective colors are configured in the same manner, only the developing device Gy for Y color will be described, and detailed description of the developing devices Gm, Gc, Gk for the other colors will be omitted.

Referring to FIGS. 2 to 5, the developing device Gy which is placed while opposing the image carrier PRy has a developing container V which houses a two-component developer containing a toner and a carrier. The developing container V has: a developing container body 1; and the developing container cover 2 which is an example of a lid member, and which closes the upper end of the developing container body 1 as shown in FIG. 2; and a developer supply/discharge tube 3 which is an example of a developer supply/discharge member, and which is coupled to the front end of the developing container body 1 as shown in FIG. 4.

Referring to FIGS. 2 to 5, the developing container body 1 has inside it: a developing roll chamber 4 which is an example of a developer carrier housing portion; a first stirring chamber 6 which is an example of a first developer housing chamber, and which is adjacent to the developing roll chamber 4; and a second stirring chamber 7 which is an example of a second developer housing chamber, and which is placed adjacently to a right lower portion of the first stirring chamber 6 in order to reduce the lateral and vertical dimensions of the developing container V. The developing roll R0 which is an example of a developer carrier is housed in the developing roll chamber 4. A layer thickness regulating member 8 for regulating the thickness of the developer on the surface of the developing roll R0 is disposed on the upstream side in the rotation direction of the developing roll R0.

Referring to FIGS. 4 and 5, in both front and rear end portions of the developing container V, a butting member Va or a so-called tracking member for setting the distance between the developing roll R0 and the image carrier PRy to a predetermined value is supported at a position opposed to the image carrier PRy.

Referring to FIG. 3, a supply/discharge chamber 6*a* inside the developer supply/discharge tube 3 is connected to the front side of the first stirring chamber 6, and a replenishment chamber 7*a* inside the developer supply/discharge tube 3 is connected to the front side of the second stirring chamber 7. Referring to FIG. 3, a developer replenishment port 3*a* to which the developer of the developer cartridge Ky, Km, Kc, Kk is replenished is formed in the upper face of a front end portion (+X end portion) of the supply/discharge chamber 6*a*. A developer discharge port 3*b* which is an example of a developer discharging portion is formed in the lower face of a rear portion of the supply/discharge chamber 6*a*, and a waste developer which is discharged and dropped through the developer discharge port 3*b* is recovered into a developer recovery container which is not shown.

In the developing container body 1, as shown in FIG. 3, a partition wall 9 is formed between the first stirring chamber 6 and the second stirring chamber 7 except the both end portions. Referring to FIGS. 3 and 4, the first stirring chamber 6 and the second stirring chamber 7 communicate with each other through an upward inflow portion E1 which is an example of a first inflow portion, and which is placed in the rear end portion, and a downward inflow portion E2 which is an example of a second inflow portion, and which is placed in the front side, so that the developer can circulate. An opening forming member 11 in which an opening for adjusting the inflow amount is formed is attached to the downward inflow portion E2.

In the developer supply/discharge tube 3, a partition wall 12 is formed between the supply/discharge chamber 6*a* and the replenishment chamber 7*a*. As shown in FIG. 3, therefore, the supply/discharge chamber 6*a* and the replenishment chamber 7*a* communicate with each other through a replenishment inflow portion E3 which is an example of a third inflow portion, so that the developer can flow from the supply/discharge chamber 6*a* to the replenishment chamber 7*a*.

A circulation stirring chamber 6 and 7 is configured by the first stirring chamber 6 and the second stirring chamber 7.

Referring to FIGS. 3 to 5, a supply auger 21 which is an example of a supplying member, and which conveys the developer while stirring the developer to supply the developer to the developing roll R0 is placed in the first stirring chamber 6.

Referring to FIGS. 3A and 3B, the supply auger 21 has: a first rotation shaft 22 which extends in the axial direction of the developing roll R0; and a first conveying vane 23 which is spiral, and which is supported on the outer circumference of the first rotation shaft 22. The first conveying vane 23 has: a replenishment reverse conveying vane 23*a* which is placed correspondingly with the front end portion of the supply/discharge chamber 6*a*; a discharge conveying vane 23*b* which is an example of a fourth conveying member, and which is placed correspondingly with the middle and rear portions of the supply/discharge chamber 6*a*; a circulation reverse conveying vane 23*c* which is an example of a reverse conveying portion and a third conveying member, and which is placed correspondingly with a range from the rear end portion of the supply/discharge chamber 6*a* to the front side of the downward inflow portion E2; and a first main stirring conveying vane 23*d* which is an example of a first conveying member, and which is placed correspondingly with a range from the downward inflow portion E2 to the rear end of the first stirring chamber 6.

In Example 1, the vanes 23*a* to 23*d* are formed into a spiral shape, and the distance by which the developer is moved by one rotation of the first main stirring conveying vane 23*d*, i.e., the distance or pitch of vanes which are adjacent to each other in the axial direction is set to be larger than the pitches of the conveying vanes 23*a* to 23*c*. In Example 1, the first rotation shaft 22 and the first conveying vane 23 of the supply auger 21 are integrally formed by a resin. Alternatively, the shaft and the conveying vane may be separately formed and then combined to each other. In Example 1, the vanes 23*a* to 23*d* are disposed on the single first rotation shaft 22. The invention is not restricted to this configuration. For example, combinations of the replenishment reverse conveying vane 23*a* and its rotation shaft, the discharge conveying vane 23*b* and its rotation shaft, the circulation reverse conveying vane 23*c* and its rotation shaft, and the first main stirring conveying vane 23*d* and its rotation shaft may be configured separately from each other.

Referring to FIGS. 3A and 3C, a stir auger 26 which is an example of a stirring member, and which conveys the developer while stirring the developer is placed in the second stirring chamber 7. The stir auger 26 has: a second rotation shaft 27 which extends in the axial direction of the developing roll R0; and a second conveying vane 28 which is spiral, and which is supported on the outer circumference of the second rotation shaft 27. The second conveying vane 28 has: a replenishment conveying vane 28*a* which is placed correspondingly with the replenishment chamber 7*a*; a second main stirring conveying vane 28*b* which is placed correspondingly with a range from the downward inflow portion E2 to the front side of the upward inflow portion E1; and a reverse conveying vane 28*c* which is placed in the rear end portion of the second stirring chamber 7.

In Example 1, the vanes 28*a* to 28*c* are formed into a spiral shape, and the pitch of the second main stirring conveying vane 28*b* is set to be larger than the pitches of the conveying vanes 28*a*, 28*c*. In the region where the second main stirring conveying vane 28*b* is disposed, as shown in FIG. 3, plural flat plate-like stirring members 28*d* are supported at predetermined intervals on the second rotation shaft 27. Referring to FIG. 3C, on the left side of the reverse conveying vane 28*c*, a stirring paddle 28*e* which is an example of a stirring portion is supported on the second rotation shaft 27. The stirring members 28*d* and the stirring paddle 28*e* are formed so that the conveying force in the circumferential direction of the second rotation shaft 27 is greater than that in the axial direction. In Example 1, particularly, the stirring members 28*d* and the stirring paddle 28*e* are configured by plate-like members which extend along the second rotation shaft 27, and exert substantially no conveying force in the axial direction.

In Example 1, also the stir auger 26 is integrally formed similarly with the supply auger 21. In Example 1, the vanes 28*a* to 28*c* are disposed on the single second rotation shaft 27. The invention is not restricted to this configuration. For example, combinations of the replenishment conveying vane 28*a* and its rotation shaft, the second main stirring conveying vane 28*b* and its rotation shaft, and the reverse conveying vane 28*c* and its rotation shaft may be configured separately from each other.

When the conveying members 21, 26 are rotated, the developer which is replenished from the developer replenishment port 3*a* is caused to flow into the replenishment inflow portion E3 by the replenishment reverse conveying vane 23*a* and the discharge conveying vane 23*b*, and then conveyed to the replenishment chamber 7*a*. The developer which is conveyed to the replenishment chamber 7*a* is conveyed by the replenishment conveying vane 28 to the second stirring chamber 7 in the developing container body 1, and further conveyed in a second developer conveying direction Ya by the second main stirring conveying vane 28*b*. The developer which is conveyed to the upward inflow portion E1 is caused to stagnate by the second main stirring conveying vane 28*b* and the reverse conveying vane 28*c* which conveys the developer in the direction opposite to the second developer conveying direction, to increase the amount of the developer, and then flows into the first stirring chamber 6 which is situated in the upward oblique side.

The developer which flows into the first stirring chamber 6 is conveyed by the first main stirring conveying vane 23*d* in a first developer conveying direction Yb opposite to the second developer conveying direction Ya. The developer which is conveyed in the first stirring chamber 6 is caused by a magnetic force to adhere to the surface of the developing roll R0 during the conveyance, and is then used in developing. The developer which is conveyed to the downward inflow portion E2 is caused to stagnate in the downward inflow portion E2 by the circulation reverse conveying vane 23*c* which tries to convey the developer in the direction opposite to the first developer conveying direction Yb, and then caused by the gravity to flow into the second stirring chamber 7 through the downward inflow portion E2. As a result, the developer in the stirring chambers 6, 7 is circulated and conveyed while being stirred by the conveying members 21, 26.

When the amount of the developer in the downward inflow portion E2 is increased, there is a case where a part of the developer cannot be conveyed in the opposite direction by the circulation reverse conveying vane 23*c*, and flows to the discharge conveying vane 23*b* on the side of the supply/discharge chamber 6*a*. In this case, the developer which flows to the side of the discharge conveying vane 23*b* with passing over the circulation reverse conveying vane 23*c* is conveyed to the developer discharge port 3*b* by the discharge conveying vane 23*b* to be discharged.

Figure 6A:
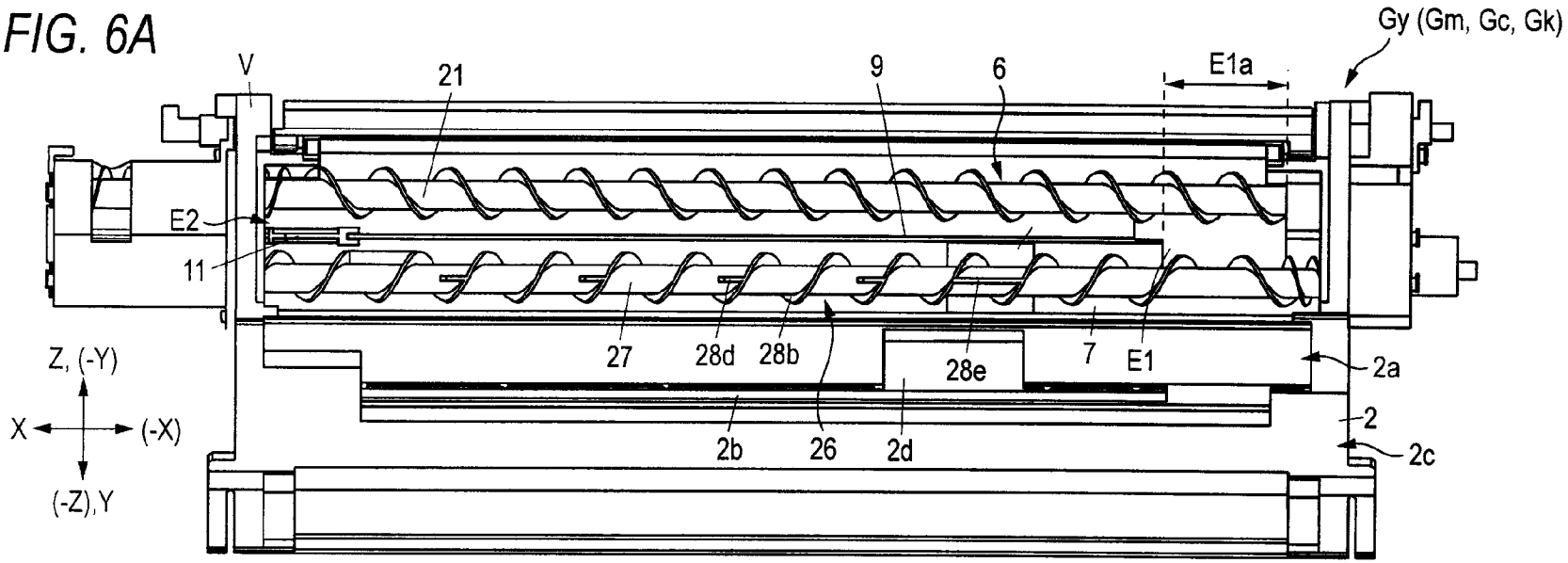
FIGS. 6A and 6B are views illustrating the developing device of Example 1.
Figure 6B:
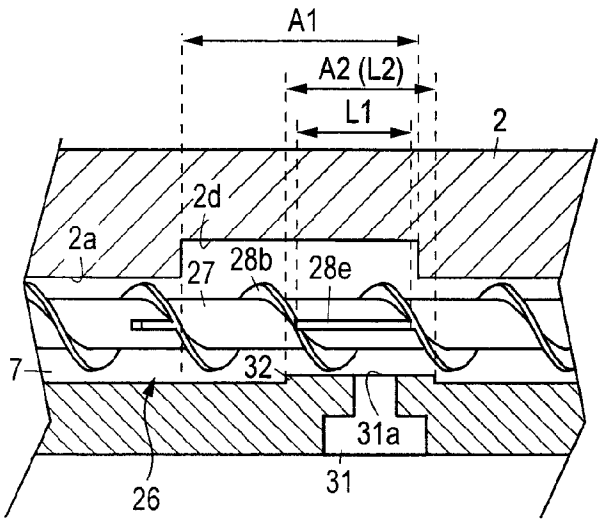

FIG. 6 is a view illustrating the developing device of Example 1, FIG. 6A is a view showing a state where the developing container cover is opened, and FIG. 6B is a section view taken along the line VIB-VIB in FIG. 5.

Figure 7:
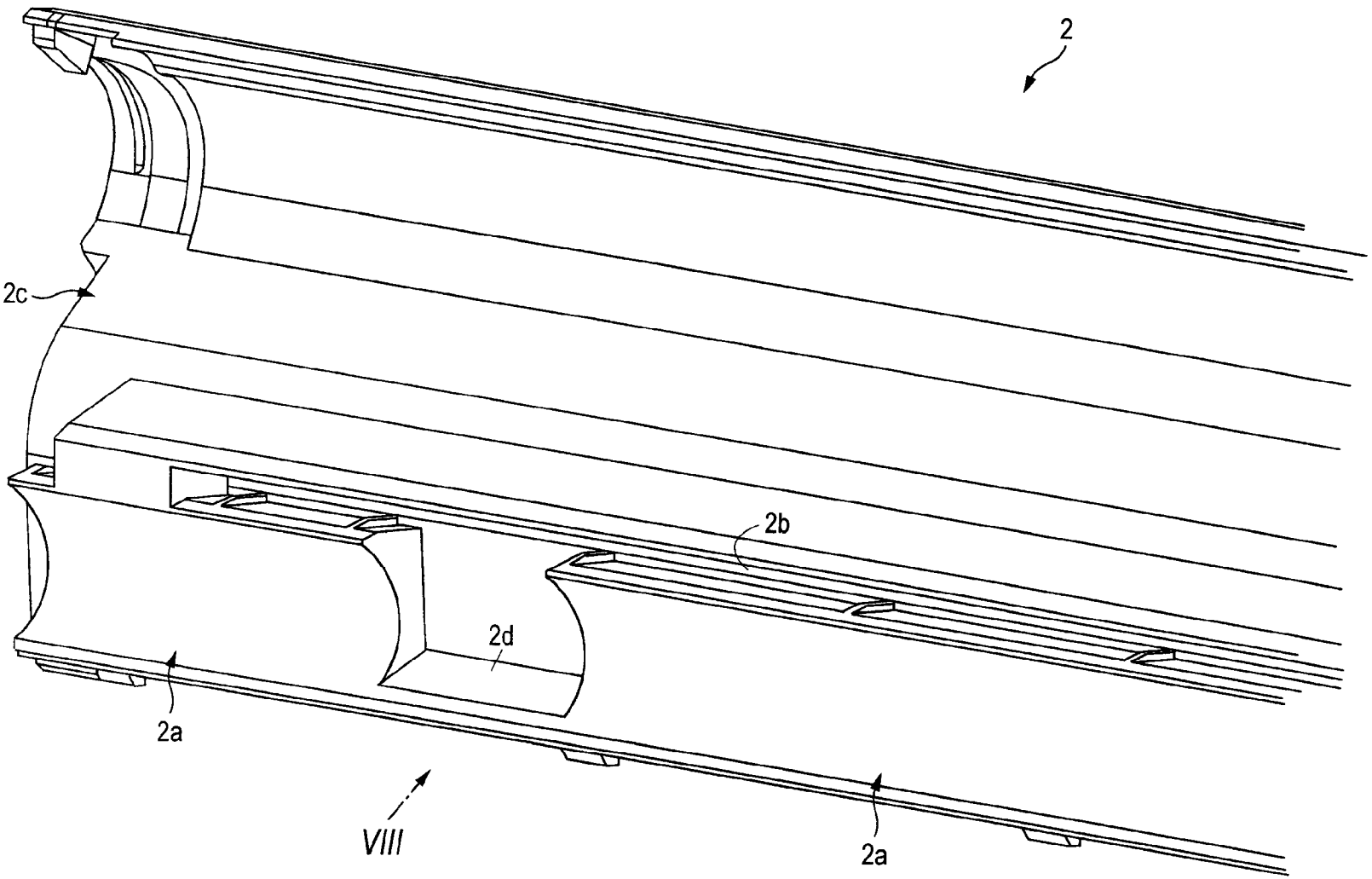
FIG. 7 is an enlarged perspective view of main portions of a rear end portion of the developing container cover in Example 1.

FIG. 7 is an enlarged perspective view of main portions of a rear end portion of the developing container cover in Example 1.

Figure 8:
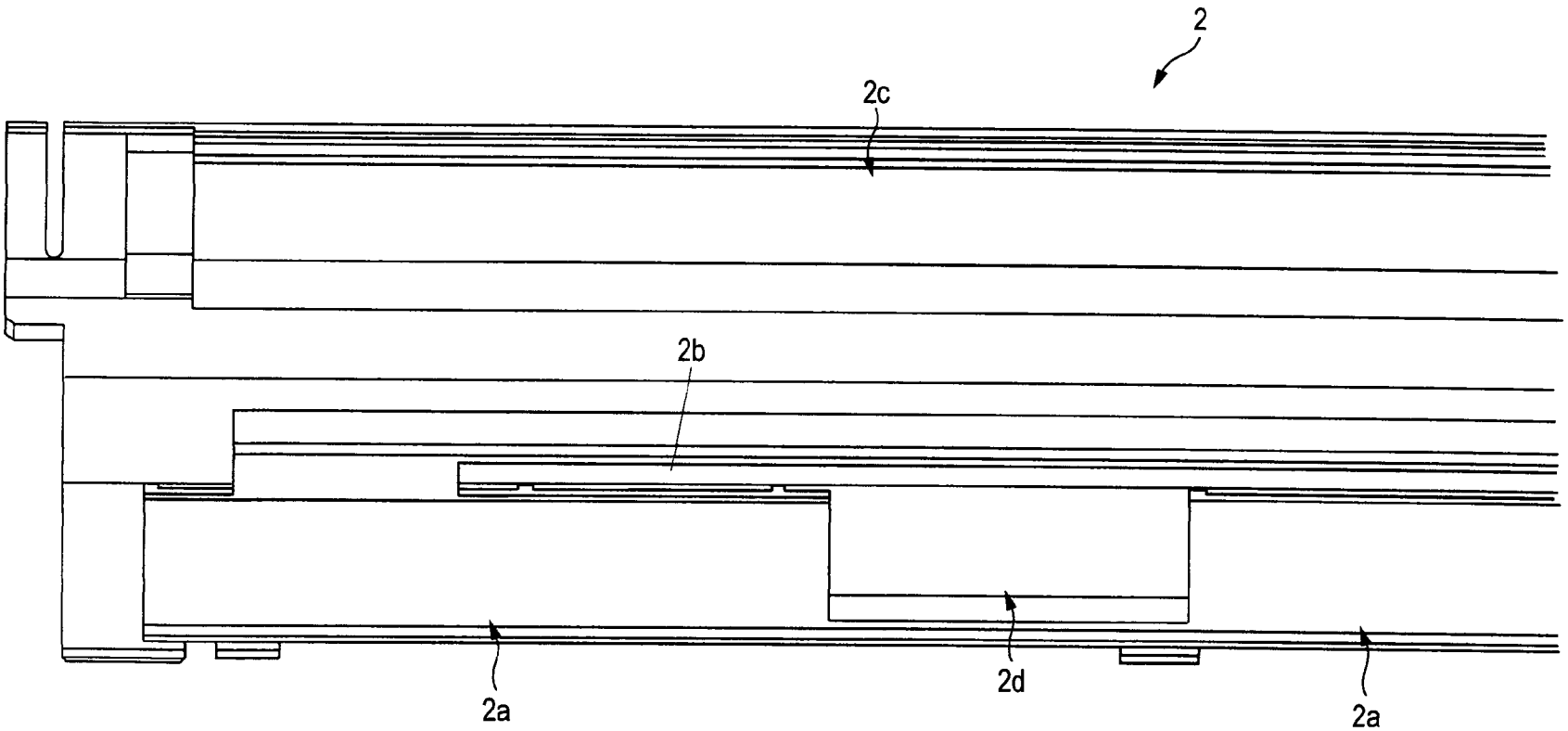
FIG. 8 is a side view as seen from the direction of the arrow VIII in FIG. 7.

FIG. 8 is a side view as seen from the direction of the arrow VIII in FIG. 7.

Figure 9:
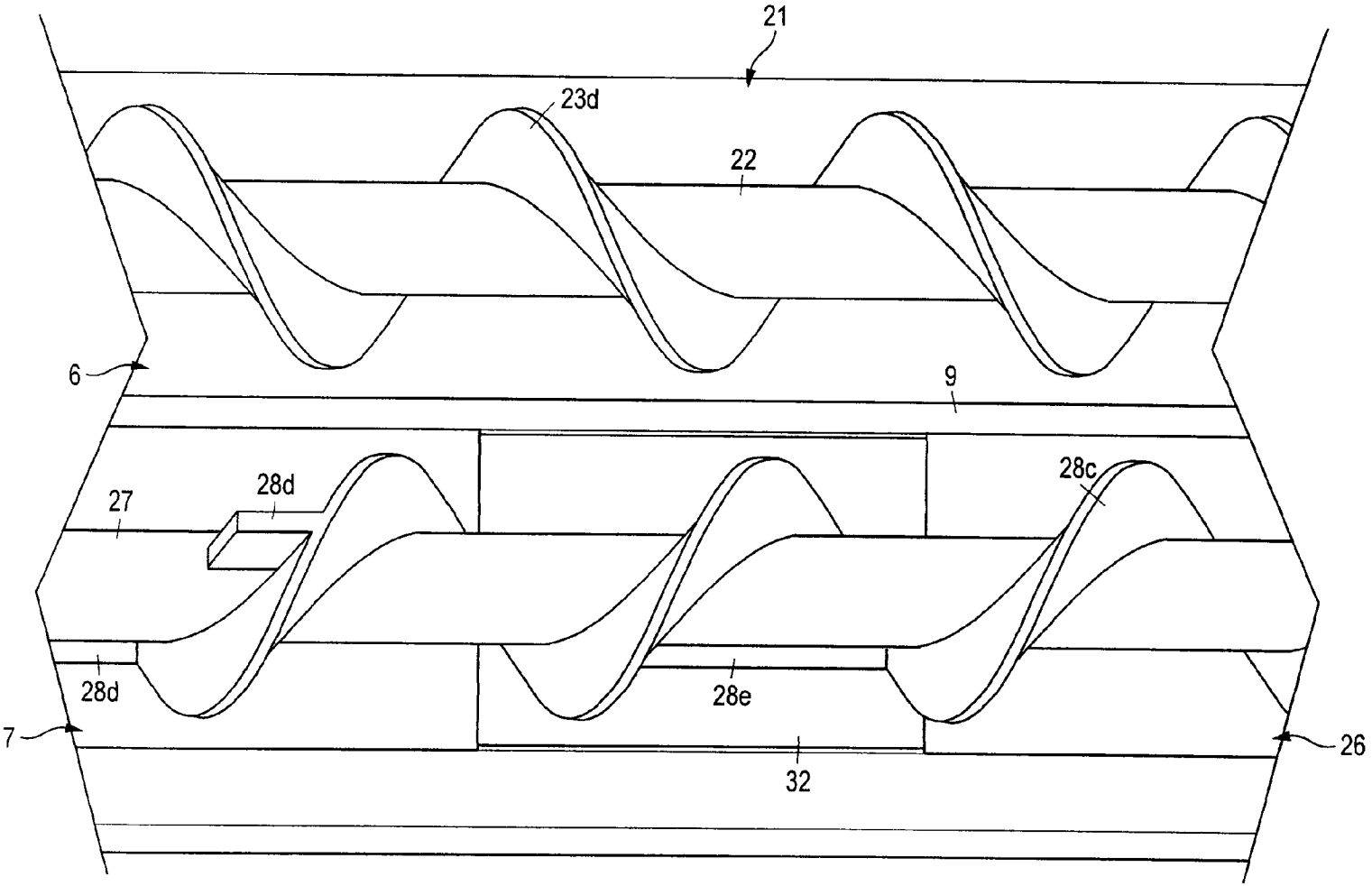
FIG. 9 is an enlarged view of main portions of a region in the vicinity of a conveying member of a developing container V in Example 1.

FIG. 9 is an enlarged view of main portions of a region in the vicinity of the conveying member of the developing container V in Example 1.

In FIG. 6, the illustration of the developing roll is omitted.

Referring to FIGS. 3, 5, and 6, as an example of a developer detecting member, a concentration detecting member 31 for detecting the concentration of the developer housed in the second stirring chamber 7 is placed in the bottom face of the second stirring chamber 7 on the upstream side of the upward inflow portion E1 in the second developer conveying direction. The concentration detecting member 31 is configured by a so-called magnetic sensor which is conventionally known, and detects the rate of the toner with respect to the total amount of the toner and the carrier. The concentration detecting member is placed in a state where a sensing surface 31*a* is directed toward the second stirring chamber.

Referring to FIGS. 4 to 8, the developing container cover 2 which covers the upper face of the developing container V has: a second upper wall face 2*a* of the second stirring chamber 7 which is formed into an arcuate shape extending along the outer shape of the stir auger 26; a partition groove portion 2*b* into which the partition wall 9 is fitted, thereby separating the first stirring chamber 6 and the second stirring chamber 7 from each other; and a first upper wall face 2*c* which constitutes the upper wall faces of the first stirring chamber 6 and the developing roll chamber 4.

Referring to FIGS. 6 to 8, in a sectional-area expanded region A1 which is set so as to include a region opposed to the concentration detecting member 31 in the second upper wall face 2*a*, as an example of a recess for expanding the sectional area, a cutaway portion 2*d* which constitutes the upper wall face of the second stirring chamber 7 in the sectional-area expanded region A1 is formed into a shape in which the second upper wall face 2*a* is partly cut away. In Example 1, the sectional area of the second stirring chamber 7 in the sectional-area expanded region A1 where the cutaway portion 2*d* shown in FIG. 5 is disposed is set so as to be larger than that of the second stirring chamber 7 in the upward inflow portion E1 in which the upper portion is closed by the upper wall face 2*a* extending along the outer shape of the stir auger 26 shown in FIG. 4.

Referring to FIGS. 6 to 9, a conveying member proximity region A2 extending in the axial direction of the stir auger 26 is set in the vicinity of the concentration detecting member 31, and a semi-arcuate raised bottom portion 32 is formed in the second stirring chamber 7 so as to extend along the bottom and side faces. As shown in FIG. 5, in the conveying member proximity region A2, therefore, the raised bottom portion 32 causes the distance between the bottom face and the second rotation shaft 27 of the stir auger 26 to be shorter than that in the upward inflow portion E1 shown in FIG. 4, so that the outer circumference of the stir auger 26 is close to the bottom face and the gap is narrowed. In the sectional-area expanded region A1, the total sectional area which is obtained after it is increased by the cutaway portion 2*d* and decreased by the raised bottom portion 32 and the stirring paddle 28*e* is set so as to be larger than the sectional area of the second stirring chamber 7 other than the cutaway portion 2*d*, such as that of the second stirring chamber 7 of an inflow portion corresponding region E1*a* corresponding to the upward inflow portion E1, i.e., the circular sectional area extending along the outer shape of the stir auger 26.

The stirring paddle 28*e* of the stir auger 26 is placed in the vicinity of the concentration detecting member 31 to stir the developer in the vicinity of the concentration detecting member 31, thereby reducing the conveying speed of the developer. In Example 1, the stirring paddle 28*e* is not placed between the downstream side of the sectional-area expanded region A1 in the second developer conveying direction and the upward inflow portion E1.

Referring to FIG. 6, in the developing devices Gy of Example 1, the width L1 of the stirring paddle 28*e* in the second developer conveying direction is set so as to be included within the width L2 of the conveying member proximity region A2. That is, the downstream end portion of the conveying member proximity region A2 in the second developer conveying direction Ya is placed on the downstream side of the downstream end portion of the stirring paddle 28*e*.

As shown in FIG. 6B, in the second developer conveying direction Ya, the downstream end of the sectional-area expanded region A1 is placed on the downstream side of the downstream end portion of the stirring paddle 28*e*. The downstream end of the sectional-area expanded region A1 is set to be located closer to an end portion of the downstream end of the stirring paddle 28*e* than the downstream end of the conveying member proximity region A2, i.e., on the upstream side of the downstream end of the conveying member proximity region A2. The upstream end of the sectional-area expanded region A1 is set to be located on the upstream side of the upstream end of the stirring paddle 28*e* in the second developer conveying direction.

On the upstream side of the stirring paddle 28*e* in the second developer conveying direction Ya, the stirring members 28*d* which are an example of a second stirring member are placed. The downstream end of the extreme downstream one of the stirring members 28*d* in the second developer conveying direction Ya is placed on the upstream side of the upstream end of the sectional-area expanded region A1.

Function of Example 1

In the image forming apparatus U of Example 1 having the above-described configuration, the developer to be used in developing in the developing device Gy to Gk is conveyed while being stirred in the developing container V. In the upward inflow portion E1, in order to allow the developer to efficiently flow from the second stirring chamber 7 in the lower side to the first stirring chamber 6 in the upper side, the upper wall face 2*a* of the second stirring chamber 7 has the shape which extends along the outer shape of the stir auger 26. The increasing/decreasing amount of the developer existing in the upward inflow portion E1 is smaller than that of the developer in the developing device Gy to Gk. Even when the amount of the developer in the developing device Gy to Gk is reduced, therefore, the developer efficiently flows into the first stirring chamber 6.

The concentration of the developer housed in the developing container V is detected by the concentration detecting member 31 of the second stirring chamber 7, and the replenishment of the developer is controlled. In the vicinity of the concentration detecting member 31, the developer is stirred by the stirring paddle 28*e*, and the developer in the vicinity of the concentration detecting member 31 placed in the bottom face is stirred, thereby reducing the stagnation. At this time, the conveying speed of the developer in the axial direction of the stir auger 26 is lowered. In the case where the total amount of the developer in the developing container V is increased by the timing difference between consumption and replenishment of the developer, in the range where the conveying speed is lowered or the stirring paddle 28*e* is placed, the developer stagnates, but the sectional area is widened by the sectional-area expanded region A1. In the sectional-area expanded region A1 where the sectional area is increased, namely, the pressure acting on the developer is not excessively raised, the developer is prevented from being pressed and packed, and the concentration is accurately detected by the concentration detecting member 31. Irrespective of the increase/decrease of the total amount of the developer, therefore, the concentration detection is performed stably and accurately as compared with the case where the sectional-area expanded region A1 is not disposed and the upper wall face at the position where the concentration detecting member 31 is disposed is identical with the upper wall face 2*a* of the upward inflow portion E1.

In the image forming apparatus U of Example 1, the raised bottom portion 32 causes the sensing surface 31*a* of the concentration detecting member 31 to be placed close to the second rotation shaft 27. Namely, the sensing surface 31*a* is placed in or in the vicinity of the flow of the developer which is directly stirred by the second main stirring conveying vane 28*b* of the stir auger 26 and the stirring paddle 28*e*, and stagnation of the developer on the sensing surface 31*a* hardly occurs, thereby improving the detection accuracy. In the image forming apparatus U of Example 1, therefore, it is possible to cope with both stagnation of the developer on the sensing surface 31*a* and the increase/decrease of the total amount of the developer, and the detection accuracy is improved and stabilized. In the image forming apparatus U of Example 1, moreover, the upstream end of the sectional-area expanded region A1 in the second developer conveying direction is set to be on the upstream side of the upstream end of the stirring paddle 28*e*, and, even when the conveying ability is reduced by the stirring paddle 28*e* to cause the developer to stagnate on the upstream side of the stirring paddle 28*e*, an excessive pressure is prevented from being applied. The upstream end of the sectional-area expanded region A1 is placed downstream of the downstream end of the extreme downstream one of the stirring members 28*d* in the second developer conveying direction Ya, and the sectional-area expanded region A1 is placed downstream of the downstream side of the stirring members 28*d* where the conveying speed of the developer begins to be lowered. In the sectional-area expanded region A1 on the downstream side of the stirring members 28*d*, namely, the conveying speed of the developer is restored, and stagnation of the developer in the sectional-area expanded region A1 is reduced.

In the image forming apparatus U of Example 1, the downstream end of the sectional-area expanded region A1 is placed on the downstream side of the downstream end portion of the stirring paddle 28*e* in the second developer conveying direction Ya. In the step part of the cutaway portion 2*d* in the downstream end of the sectional-area expanded region A1 which is placed on the downstream side of the stirring paddle 28*e* where the developer begins to stagnate, the conveying speed of the developer is restored, and an influence due to stagnation of the developer is reduced in the step part of the cutaway portion 2*d*.

In the image forming apparatus U of Example 1, the width L1 of the stirring paddle 28*e* in the second developer conveying direction is set so as to be included within the width L2 of the conveying member proximity region A2, and the downstream end of the conveying member proximity region A2 is placed at the position which is on the downstream side of the region where the conveying speed is lowered by the stirring paddle 28*e*, and in which the conveying speed is increased. Namely, the conveying speed is made higher in the downstream end of the conveying member proximity region A2, and stagnation of the developer in the step part of the raised bottom portion 32 is reduced.

As shown in FIG. 6B, in the second developer conveying direction, the downstream end of the sectional-area expanded region A1 is set at a position closer to the downstream end portion of the stirring paddle 28*e* than to the downstream end of the conveying member proximity region A2, i.e., on the upstream side. In the region which is on the downstream side of the stirring paddle 28*e*, and in which the conveying speed is restored, stagnation of the developer which may possibly occur is prevented from occurring by setting the step part of the downstream end of the sectional-area expanded region A1. When the amount of the developer in the developing device Gy to Gk is increased, particularly, stagnation of the developer which occurs in the step part of the downstream end portion of the raised bottom portion 32 is effectively reduced by placing the downstream end portion of the sectional-area expanded region A1 where the amount of the developer is increased more easily than the other regions, at the upstream side of the step of the downstream end portion of the conveying member proximity region A2 corresponding to the raised bottom portion 32.

In the image forming apparatus U of Example 1, the stirring paddle 28*e* and the stirring members 28*d* are not disposed between the downstream side of the sectional-area expanded region A1 and the upward inflow portion E1, and stagnation of the developer between the sectional-area expanded region A1 and the upward inflow portion E1 is reduced. Between the first inflow portion in which the developer must be lifted or upward in the gravitational direction, and the developer easily stagnates, and the region where the stirring members are placed in the opposed region, and the concentration detecting member in which the developer easily stagnates is placed, it is possible to reduce continuous stagnation of the developer which stagnates in the first inflow portion, to the region where the concentration detecting member is placed. Namely, the lifting of the developer is effectively performed by causing the developer to flow from the region which is between the sectional-area expanded region A1 and the upward inflow portion E1, and in which little stagnation occurs, into the upward inflow portion E1.

Example 2

Next, Example 2 of the invention will be described. In the description of Example 2, the components corresponding to those of Example 1 are denoted by the same reference numerals, and their detailed description will be omitted.

Example 2 is configured in the same manner as Example 1 except the following points.

Figure 10A:
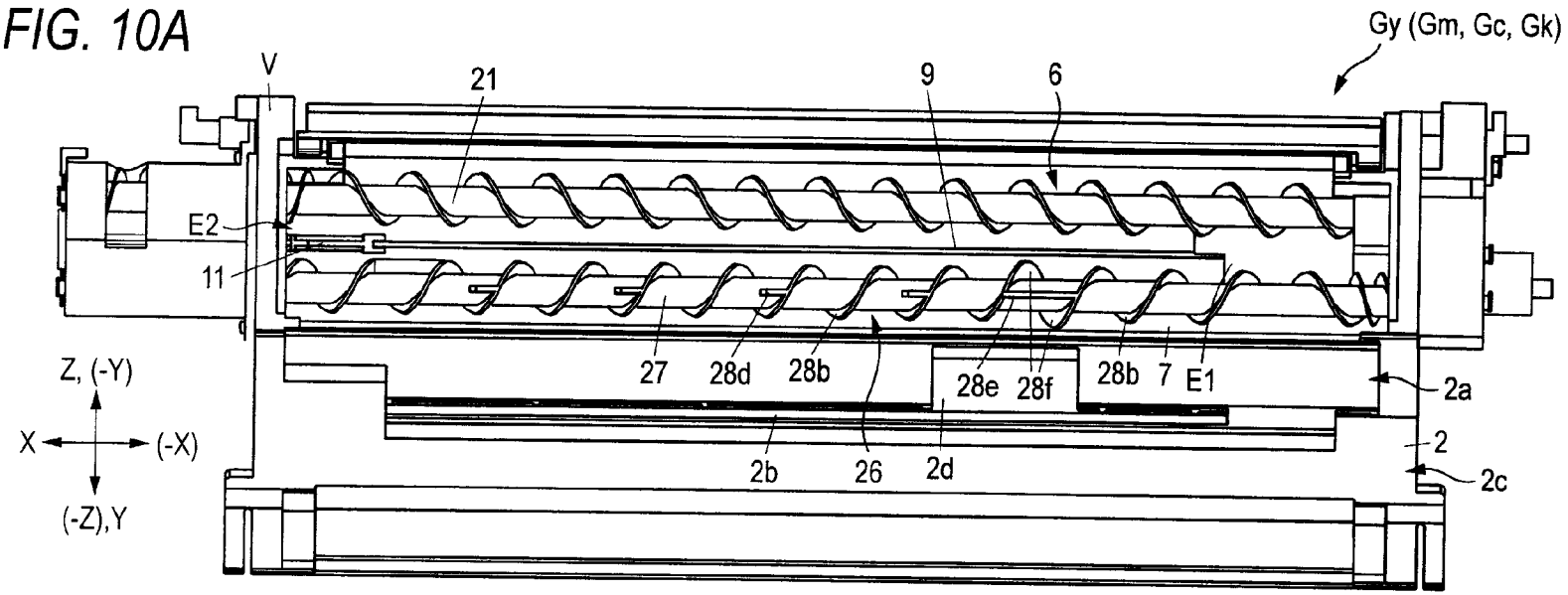
FIGS. 10A and 10B are views illustrating the developing device of Example 2 corresponding to FIG. 6 of Example 1.
Figure 10B:
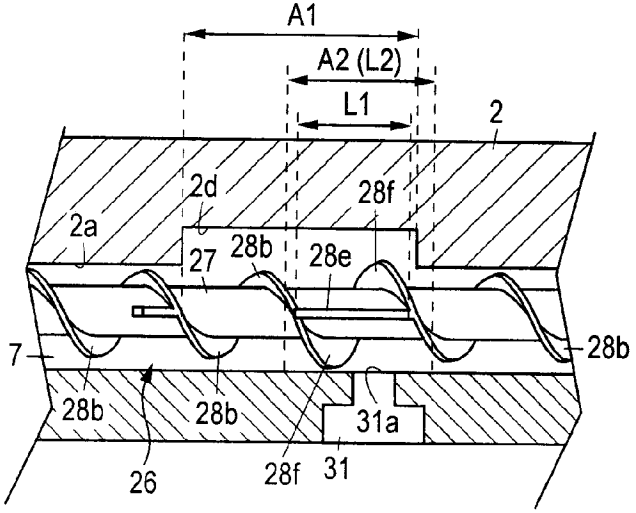

FIG. 10 is a view illustrating the developing device of Example 2 corresponding to FIG. 6 of Example 1, FIG. 10A is a view showing a state where the developing container cover is opened, and FIG. 10B is a section view of main portions.

Referring to FIG. 10, in the developing device Gy of Example 2, in place of the raised bottom portion 32, the portion of the conveying member proximity region A2 of the second main stirring conveying vane 28*b* is configured by a large vane 28*f* which is larger in outer shape than the other portions, and set so as to, during rotation, pass the vicinity of the concentration detecting member 31. Also in the developing device Gy of Example 2, in the sectional-area expanded region A1, the total sectional area which is obtained after it is decreased by the large vane 28*f* and the stirring paddle 28*e* and increased by the cutaway portion 2*d* is set so as to be larger than the sectional area of the inflow portion corresponding region E1*a*.

(Function of Example 2)

In the image forming apparatus of Example 2 having the above-described configuration, stagnation of the developer in the vicinity of the sensing surface 31*a* of the concentration detecting member 31 is reduced by the large vane 28*f* in the same manner as the raised bottom portion 32 in Example 1. Even when, in order to reduce stagnation and improve the detection accuracy, the outer shape of the stir auger 26 is increased, namely, the detection accuracy of the concentration detecting member 31 due to the increase/decrease of the total amount of the developer can be improved and stabilized.

(Modifications)

Although, in the above, the examples of the invention have been described in detail, the invention is not restricted to the examples. Various modifications are enabled within the scope of the spirit of the invention set forth in the claims. Modifications (H01) to (H06) of the invention will be exemplified.

(H01) In the examples, a copier is exemplified as the image forming apparatus. The invention is not restricted to this. The image forming apparatus may be configured as a facsimile apparatus, a printer, or a multifunction machine having all or plural functions of such apparatuses. The image forming apparatus having the image carriers PRy to PRk, developing devices Gy to Gk, and latent-image forming devices LHy to LHk which are used for the four colors has been described. The invention is not restricted to this. The invention can be applied also to a monochrome image forming apparatus, and a rotary type image forming apparatus in which a single image carrier and a single latent-image forming device are used, and four developing devices are rotated to be sequentially opposed to the image carrier.

(H02) In the examples, the downstream end portions of the sectional-area expanded region A1 and the conveying member proximity region A2 are formed into a step shape. The invention is not restricted to this. The portions may be formed as a continuously changing surface such as an inclined surface which is inclined from the upstream side toward the downstream side, or an arcuate surface. In the case of an inclined surface or the like, a so-called dead space such as a step shape is hardly formed, and stagnation of the developer is reduced further effectively.

(H03) In the examples, the downstream end of the conveying member proximity region is set to be downstream of the downstream end of the sectional-area expanded region A1. The invention is not restricted to this. Their positional relationship may be inverted, or they may be at the same position.

(H04) In the examples, it is preferable to dispose the conveying member proximity region. Alternatively, the region may be omitted.

(H05) In the examples, the conveying speed of the developer is reduced by the stirring paddle 28*e*. The invention is not restricted to the configuration. For example, the conveying speed may be reduced by arbitrary conveying speed reducing means such as increasing the diameter of the second rotation shaft, or changing the inclination angle or pitch of the second main stirring conveying vane 28*b*.

(H06) In the examples, as the stirring member and the second stirring member, the stirring paddle 28*e* and the stirring members 28*d* are exemplified. The stirring members are not restricted to plate-like ones which are shown in the examples, and which extend in the axial direction. A member having a shape in which the conveying force in the circumferential direction is greater than that in the axial direction may be used. For example, a plate-like stirring member which does not extend in the axial direction, and which is slightly inclined may be employed.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developing device comprising:

a developer carrier that is rotated while holding a developer on a surface;

a first housing chamber that houses the developer to be supplied to the developer carrier;

a second housing chamber that has a bottom face that is lower than a bottom face of the first housing chamber in a gravitational direction;

a first inflow portion that allows the developer to flow from the second housing chamber into the first housing chamber;

a first conveying member that is provided in the first housing chamber, and that conveys the developer in the first housing chamber;

a second conveying member that is provided in the second housing chamber, and that conveys the developer in the second housing chamber in a second conveying direction directed toward the first inflow portion; and a concentration detecting member that is provided in the bottom face of the second housing chamber upstream from the first inflow portion in the second conveying direction, and that detects a concentration of the developer housed in the second housing chamber, wherein:

the second conveying member includes:

a stirring member which opposes the concentration detecting member, and that stirs the developer in a circumferential direction of the stirring member by making a first conveying force in the circumferential direction greater than a second conveying force in an axial direction of the stirring member, the second housing chamber includes:

an inner wall face;

a region of the inner wall face which opposes the first inflow portion, and that is formed into a shape extending along an outer shape of the second conveying member; and a recess that is provided in a region of the inner wall face which opposes the concentration detecting member, and in which a sectional area of the region opposed to the concentration detecting member and perpendicular to the second conveying direction is larger than a sectional area of the region opposed to the first inflow portion and perpendicular to the second conveying direction, and wherein a part of the inner wall face of the second housing chamber, including the region where the concentration detecting member is provided, is projected from the region of the inner wall face opposed to the first inflow portion.

2. The developing device as claimed in claim 1, wherein:

the recess includes a downstream end portion in the second conveying direction, and the downstream end portion of the recess is positioned downstream in the second conveying direction from a downstream end portion of the stirring member in the second conveying direction.

3. The developing device as claimed in claim 1, wherein a region of the second conveying member which opposes the concentration detecting member has an outer diameter which is larger than an outer diameter of a region of the second conveying member which opposes the first inflow portion.

4. The developing device as claimed in claim 1, wherein, in the second housing chamber, a part of the inner wall face including the region where the concentration detecting member is provided is projected from the region of the inner wall face opposed to the first inflow portion, and in the sectional area of the region of the second housing chamber opposed to the concentration detecting member and perpendicular to the second conveying direction, a first amount increased by the recess is larger than a second amount decreased by projecting the part of the inner wall face including the region where the concentration detecting member is provided.

5. The developing device as claimed in claim 4, wherein a downstream end portion of the region where the part of the inner wall face is projected in the second conveying direction is provided downstream in the second conveying direction from a downstream end portion of the stirring member in the second conveying direction.

6. The developing device as claimed in claim 4, wherein:

the recess includes a downstream end portion in the second conveying direction, the downstream end portion is positioned upstream in the second conveying direction from a downstream end portion of the region where the part of the inner wall face is projected in the second conveying direction.

7. The developing device as claimed in claim 1, wherein:

the second conveying member includes:

a second stirring member that is provided upstream from of the stirring member in the second conveying direction, and that stirs the developer in a circumferential direction of the second stirring member by making a first conveying force in the circumferential direction greater than a second conveying force in an axial direction of the second stirring member, and the recess includes an upstream end portion in the second conveying direction, the upstream end portion is positioned downstream in the second conveying direction from a downstream end portion of the second stirring member in the second conveying direction.

8. The developing device as claimed in claim 7, wherein a member that stirs the developer in the circumferential direction of the second conveying member by making the first conveying force greater than the second conveying force is not provided downstream from the downstream end portion of the region where the concentration detecting member is provided, in the second conveying direction, and upstream from of the upstream end portion of the first inflow portion in the second conveying direction.

9. An image forming apparatus comprising:

an image carrier that has a surface on which a latent image is formed;

a developing device according to claim 1 that develops the latent image on the surface of the image carrier into a visible image;

a transferring device that transfers the visible image developed on the surface of the image carrier, to a medium; and a fixing device that fixes the visible image transferred to the medium.

10. The developing device as claimed in claim 3, wherein the second conveying member comprises a rotation shaft and a conveying vane which is spirally wrapped around the rotation shaft, and wherein a region of the conveying vane which opposes the concentration detecting member has an outer diameter which is larger than an outer diameter of a region of the conveying vane which opposes the first inflow portion.

11. The developing device as claimed in claim 10, wherein the second conveying member comprises a rotation shaft and a conveying vane which is spirally wrapped around the rotation shaft, and wherein a region of the conveying vane which opposes the concentration detecting member has an outer diameter which is larger than an outer diameter of a region of the conveying vane which opposes the first inflow portion.

12. A developing device comprising:

a developer carrier that is rotated while holding a developer on a surface;

a first housing chamber that houses the developer to be supplied to the developer carrier;

a second housing chamber;

a first inflow portion that allows the developer to flow from the second housing chamber into the first housing chamber;

a first conveying member that is provided in the first housing chamber, and that conveys the developer in the first housing chamber;

a second conveying member that is provided in the second housing chamber, and that conveys the developer in the second housing chamber in a second conveying direction directed toward the first inflow portion; and a concentration detecting member that is provided in a bottom face of the second housing chamber upstream from the first inflow portion in the second conveying direction, and that detects a concentration of the developer housed in the second housing chamber, wherein:

the second conveying member includes:

a stirring member which opposes the concentration detecting member, and that stirs the developer in a circumferential direction of the stirring member by making a first conveying force in the circumferential direction greater than a second conveying force in an axial direction of the stirring member, the second housing chamber includes:

an inner wall face;

a region of the inner wall face which opposes the first inflow portion, and that is formed into a shape extending along an outer shape of the second conveying member; and a part of the inner wall face of the second housing chamber, including the region where the concentration detecting member is provided, which is projected from the region of the inner wall face opposed to the first inflow portion.

13. The developing device as claimed in claim 12, wherein a downstream end portion of the region where the part of the inner wall face is projected in the second conveying direction is provided downstream in the second conveying direction from a downstream end portion of the stirring member in the second conveying direction.

14. A developing device comprising:

a developer carrier that is rotated while holding a developer on a surface;

a first housing chamber that houses the developer to be supplied to the developer carrier;

a second housing chamber;

a first inflow portion that allows the developer to flow from the second housing chamber into the first housing chamber;

a first conveying member that is provided in the first housing chamber, and that conveys the developer in the first housing chamber;

a second conveying member that is provided in the second housing chamber, and that conveys the developer in the second housing chamber in a second conveying direction directed toward the first inflow portion; and a concentration detecting member that is provided in a bottom face of the second housing chamber upstream from the first inflow portion in the second conveying direction, and that detects a concentration of the developer housed in the second housing chamber, wherein:

the second conveying member includes:

a stirring member which opposes the concentration detecting member, and that stirs the developer in a circumferential direction of the stirring member by making a first conveying force in the circumferential direction greater than a second conveying force in an axial direction of the stirring member, wherein a region of the second conveying member which opposes the concentration detecting member has an outer diameter which is larger than an outer diameter of a region of the second conveying member which opposes the first inflow portion.

* * * * *